US006485120B1

(12) United States Patent
Pomerleau et al.

(10) Patent No.: US 6,485,120 B1
(45) Date of Patent: Nov. 26, 2002

(54) DRAWER GLIDE FOR DRAWER SLIDE ASSEMBLY

(75) Inventors: Lawrence J. Pomerleau, Lake Zurich; Paul C. Evans, Chicago, both of IL (US)

(73) Assignee: Kenlin Group, Inc., Highland Park, IL (US)

( * ) Notice: Subject to any disclaimer, the term of this patent is extended or adjusted under 35 U.S.C. 154(b) by 63 days.

(21) Appl. No.: 09/638,474

(22) Filed: Aug. 14, 2000

Related U.S. Application Data

(63) Continuation-in-part of application No. 09/348,780, filed on Jul. 7, 1999, now Pat. No. 6,116,706.

(51) Int. Cl.[7] ..... A47B 88/16

(52) U.S. Cl. ..... 312/334.27; 312/334.44

(58) Field of Search ..... 312/334.1, 334.7, 312/334.12, 334.14, 334.15, 334.44, 334.46, 334.16, 334.27

(56) References Cited

U.S. PATENT DOCUMENTS

| | | | | |
|---|---|---|---|---|
| 3,201,187 A | | 8/1965 | Reiss, Sr. et al. | |
| 3,328,107 A | | 6/1967 | Gutner | |
| 3,477,770 A | | 11/1969 | Neimi | |
| 4,389,079 A | | 6/1983 | Cosme | |
| 4,441,773 A | | 4/1984 | Leiper | |
| 4,501,453 A | | 2/1985 | Gutner et al. | |
| 4,534,600 A | | 8/1985 | Cosme | |
| RE32,134 E | | 5/1986 | Gutner et al. | |
| 4,834,555 A | | 5/1989 | Grass | |
| 4,890,938 A | | 1/1990 | Allen et al. | |
| 5,011,242 A | | 4/1991 | Cosme | |
| 5,243,736 A | | 9/1993 | Cannaday et al. | |
| 5,257,861 A | | 11/1993 | Domenig et al. | |
| 5,265,953 A | | 11/1993 | Rock et al. | |
| 5,306,080 A | * | 4/1994 | Lautenschlager et al. | 312/334.5 |
| 5,403,097 A | | 4/1995 | Woof | |
| 5,549,376 A | * | 8/1996 | Domenig | 312/334.7 |
| 5,664,855 A | | 9/1997 | Lautenschlager et al. | |
| 5,785,401 A | | 7/1998 | Bowyer et al. | |
| 5,823,648 A | * | 10/1998 | Domenig | 312/334.7 |

FOREIGN PATENT DOCUMENTS

| | | |
|---|---|---|
| TW | 89113482 | 4/1992 |

* cited by examiner

*Primary Examiner*—John G. Weiss
*Assistant Examiner*—Michael J. Fisher
(74) *Attorney, Agent, or Firm*—Marshall, Gerstein & Borun.

(57) ABSTRACT

An improved drawer glide for a drawer slide assembly provides drawer slide securement means taking the form of an internal recess with a ramped locking tab that lockingly secures a rear portion of an elongated metal drawer slide extending past a rear panel of a drawer. By providing the recess within the drawer glide as part of the drawer slide securement means, a range of lengths of drawer slides may be used for a given drawer length, significantly reducing the number of different sizes of drawer slides required to meet demands of the furniture industry. The ramped locking tab also facilitates furniture assembly by providing reliable securement of the drawer slide in the drawer guide prior to installation on in a furniture unit. External integral reinforcement means are also provided in the form of gussets.

18 Claims, 7 Drawing Sheets

DRAWER GLIDE FOR DRAWER SLIDE ASSEMBLY

RELATED APPLICATIONS

This application is a continuation-in-part of U.S. patent application Ser. No. 09/348,780, filed Jul. 7, 1999, now issued U.S. Pat. No. 6,116,706.

BACKGROUND

1. Field of the Invention

This invention relates generally to furniture drawer slide assemblies and, more specifically, to an improved drawer glide that can be used with a variety of lengths of drawer slides, thereby reducing the number of different lengths of In drawer slides required for use with drawers of various lengths, and which ensures better securement between the drawer glide and the drawer slide.

2. Description of the Prior Art

In order to improve the ease of sliding of wood drawers, many furniture manufacturers have adopted the use of metal drawer slide assemblies, which utilize an elongated stationary lower metal drawer guide, also known as a case guide, secured to the inside structure of the furniture article, an elongated upper metal drawer slide secured to the bottom of a drawer at the front and rear ends of the drawer, and a plastic drawer glide mounted to the rear wall of a drawer to facilitate movement of the drawer along the lower metal drawer guide. In most conventional drawer slide assemblies, the lower metal drawer guide consists of a generally U-shaped (or T-shaped) metal rail in cross-section, having flanges projecting horizontally outwardly from the upper ends thereof. Each of these horizontally projecting flanges is typically folded over along its length, so that the effective thickness of each horizontal flange is twice the thickness of the metal used to fabricate the metal rail. The upper metal drawer slide found in the prior art, is generally C-shaped in cross-section and has an integral, upwardly-extending metal tab member at the rear end thereof that is secured to the rear wall of the drawer. A typical arrangement of such conventional drawer slide assemblies is shown in co-owned U.S. Pat. Nos. Re. 32,134 and 4,501,452.

A plastic stop member, referred to by many in the art as a case glide, is also provided at or near the front end of the elongated lower metal drawer guide that serves to prevent the drawer from being prematurely or inadvertently pulled out of the associated furniture unit. The plastic drawer glide is provided with a pair of opposing ways: or runners that provide plastic-to-metal, as opposed to metal-to-metal, bearing surface to facilitate movement of the drawer along the elongated lower drawer guide. The opposing ways receive and ride along the outwardly projecting horizontal flanges of the drawer guide. A gap in the drawer glide just above the opposing ways can desirably barely accommodate the horizontal projections of the plastic stop member with no interference, so that the drawer can be inserted in the furniture unit with the stop and the drawer glide already installed. This gap also allows the drawer to be removed from the furniture unit, but only upon the use of sufficient force to squeeze the horizontal projections of the stop member into the gap of the drawer glide. Thus, the stop provides a warning to a user that the drawer is about to be pulled out of the furniture unit, and application of additional force will cause the drawer glide to pass beyond the stop.

A major shortcoming of the conventional drawer slide assembly is the need to provide drawer length-specific sizes of drawer slides. One reason that drawer length-specific sizes of drawer slides are required is that the upwardly-extending tab member at the rear end of the drawer slide provides the primary means for securing the rear end of the drawer slide to the bottom of the drawer. As a result, the drawer slide could not have a length that would cause the tab member to extend past the rear wall of the drawer.

The drawer glide of many conventional drawer slide assemblies is a plastic part that utilizes an elongated integral plastic male extension that is received inside the rear end of the C-shaped drawer slide. The plastic extension of the drawer glide is inserted into the rear end of the C-shaped drawer slide until a front face of the drawer glide lies flush against the upwardly-extending tab member at the rear end of the drawer slide. Screws or other suitable fasteners are used to secure both the drawer glide and the upwardly-extending tab member to the rear wall of the drawer. While the plastic extension of the drawer glide may provide some incidental support to the drawer slide, the primary purpose of the plastic extension is to provide a plastic bearing surface to facilitate movement of the drawer along the drawer guide.

By only being able to match a specific length of drawer slide with a given drawer length, a large array of drawer slides having various lengths must be manufactured to meet the demands of the furniture industry. This increases the number of stock-keeping units ("SKU's") that must be provided by the supplier of drawer slide assemblies.

The upwardly-extending tab portion at the rear of the drawer slide also requires additional working of the metal during manufacture of the drawer slide, which adds to production time and cost. Similarly, there are disadvantages of conventional metal drawer slides due to the cost of complicated tooling for stamping manufacturing processes, or alternatively, where the metal drawer slides are roll formed, not only is complicated tooling required, but also, production time is detrimentally slowed down. The present invention overcomes these shortcomings by eliminating the upwardly-extending tab portion of the metal drawer slide and changing the manner in which the drawer glide couples with the rear end of the drawer slide and the rear wall of the drawer.

SUMMARY OF THE INVENTION

It is an object of the present invention to provide a drawer slide assembly that can be used on a variety of lengths of drawers, so as to significantly reduce the number of SKU's, or different lengths of drawer slides, required to meet the demands of the furniture industry. Instead of having a drawer slide that terminates at an upwardly-extending tab member at the rear end of the metal drawer slide, the present invention requires the drawer slide to extend past the rear wall of the drawer.

This object of the present invention is achieved by means of an improved drawer glide., wherein instead of a male plastic forwardly-projecting extension of the drawer glide, the drawer glide is provided with a female recess in its front face. The metal drawer slide projects rearwardly beyond the rear wall of the drawer and is received in the female recess of the drawer glide. In a first embodiment of the improved drawer glide, the female recess is present instead of the male plastic extension. The female recess is of sufficient depth to accommodate a length of a drawer slide that extends as much as ¼ inch beyond the rear wall of the drawer. According to this embodiment, the drawer slides can thus be provided with a manufacturing tolerance of 1/16", as opposed to needing more exact drawer-length specific drawer slides.

In a most preferred embodiment, the recess of the plastic drawer glide is elongated, having sufficient depth to accommodate a length of drawer slide that extends as much as ½ inch beyond the rear wall of the drawer, whereby a greater variety of lengths of drawers can be used with a given drawer slide. The drawer slides can vary in ¼" increments, resulting in fewer drawer slide SKU's than the first embodiment of the present invention.

A need exists to reinforce the walls of the female recess and a wall member forming the main vertical body portion of the plastic drawer glide. This need arises from the fact that a rear-most portion of the drawer slide is received within the female recess of the drawer glide, and the drawer slide transfers internal stresses, direct forces, and torque, for example from the weight of the drawer and the weight of the contents of the drawer, to the drawer glide. The drawer slide receiving area of the female recess also may be slightly smaller than the cross-sectional dimension of the rear-most portion of the drawer slide, so the drawer slide may have a tendency to bias opposing ways of the drawer glide away from one another, tending to weaken or crack the drawer glide. Reinforcement of the drawer glide is therefore desirable to compensate for these factors. One form of such reinforcement is the use of a metal insert plate imbedded within the plastic drawer glide. The metal insert plate provides internal rigidity and strength to the drawer glide.

Another form of reinforcement, which has several benefits from a manufacturing standpoint, is the use of integral flanges or gussets between the outer walls defining the female recess and the wall member forming the main vertical body portion of the drawer glide. These integral flanges or gussets are preferably wedge-shaped, i.e. pie-shaped, and are spaced along the sidewalls and top wall forming the female recess of the drawer glide.

Another improvement incorporated into the drawer glide of the present invention is a locking mechanism to ensure securement of the rear-most end of the drawer slide within the female recess of the drawer glide. This locking mechanism preferably takes the form of a ramped locking tab extending downwardly from the upper wall of the female recess of the drawer glide. A complementary aperture spaced inwardly from the extreme rear end of the drawer slide receives the locking tab once the drawer slide has been inserted a sufficient distance into the drawer glide.

Advantageously, this locking mechanism allows for easy preassembly of the drawer slide and drawer glide prior to attachment to a drawer, which assists in obtaining proper perpendicular alignment of the drawer slide relative to the rear wall of the drawer once the drawer slide and drawer glide are attached to the drawer. By extending from the upper wall of the female recess of the drawer glide, the integral plastic locking tab also beneficially avoids the need for any metal back bent tabs along the length of the drawer slide, which allows for less difficult and less expensive roll-forming or stamping of the drawer slide.

The drawer glide also has opposing ways that extend forwardly of the main wall member of the drawer glide, resulting in a longer gliding surface, i.e. a longer region of sliding contact between the opposing ways of the drawer glide and the metal drawer slide.

Further features and benefits of the present invention will be appreciated by reference to the drawings and in the following detailed description of the preferred embodiments.

DETAILED DESCRIPTION OF THE PREFERRED EMBODIMENTS

Conventional Drawer Slide Assemblies

Figure 1:
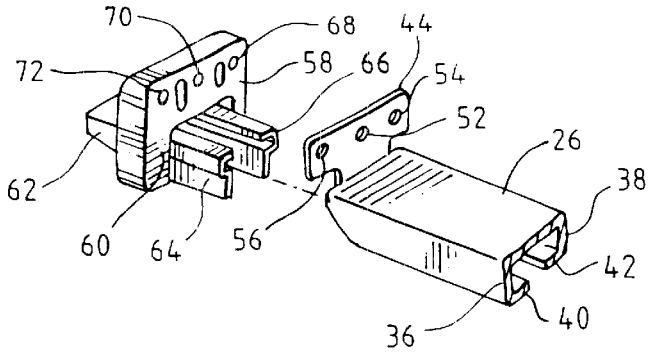
FIG. 1 PRIOR ART
FIG. 1 is a fragmentary exploded front perspective view of a conventional prior art drawer glide and drawer slide combination.
Figure 2:
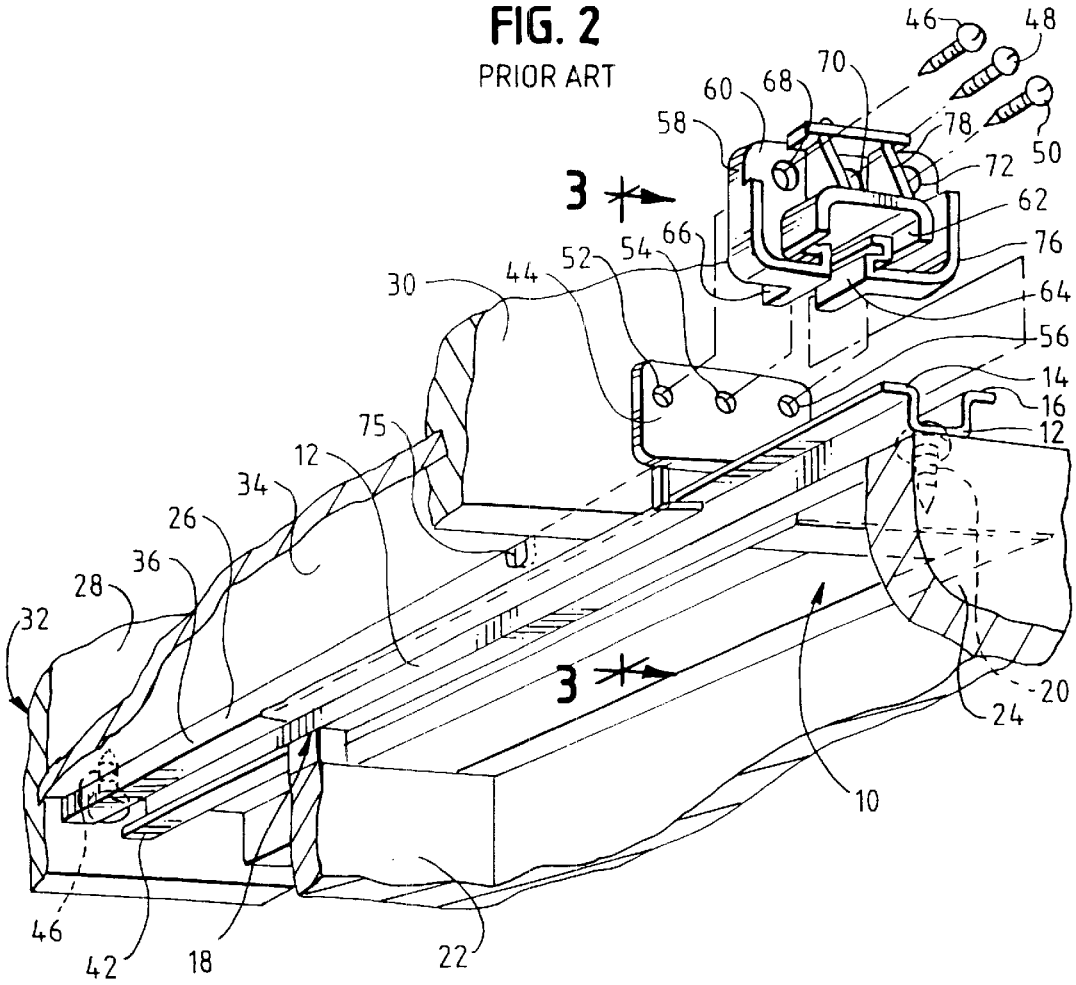
FIG. 2 PRIOR ART
FIG. 2 is a partially exploded rear perspective view, broken away, of a conventional prior art drawer slide assembly.
Figure 3:
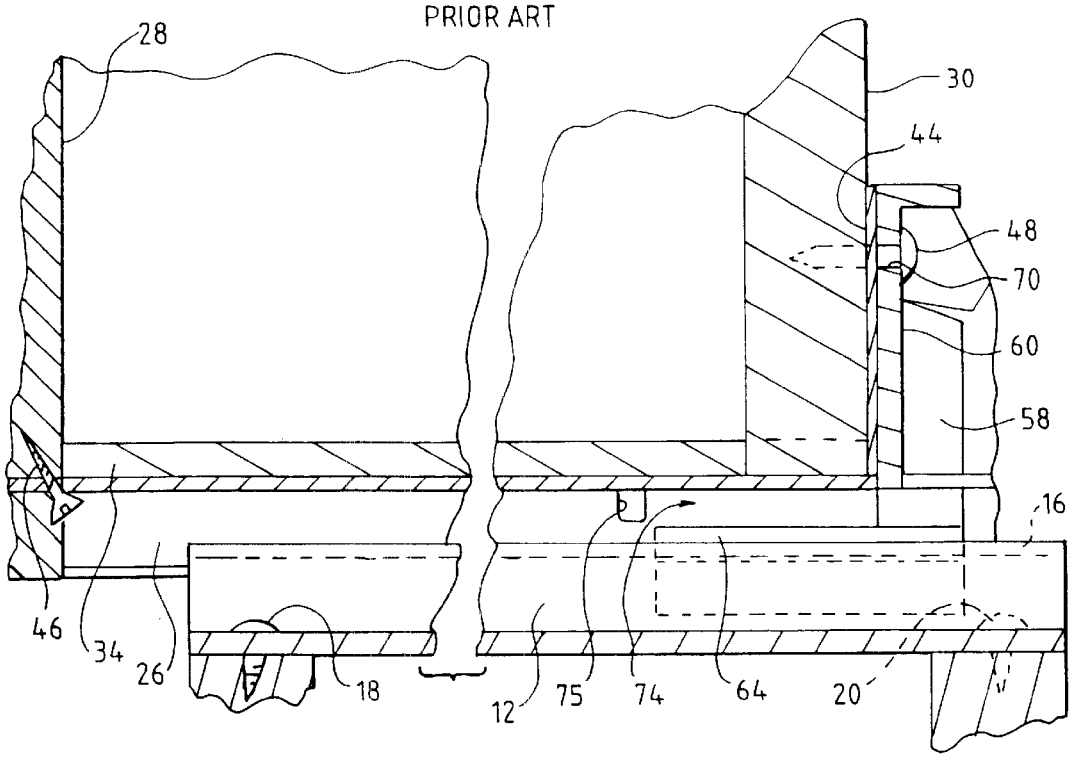
FIG. 3 PRIOR ART
FIG. 3 is a cross-section taken along lines 3—3 of FIG. 2 of the prior art drawer slide assembly shown in FIG. 2.
Figure 4:
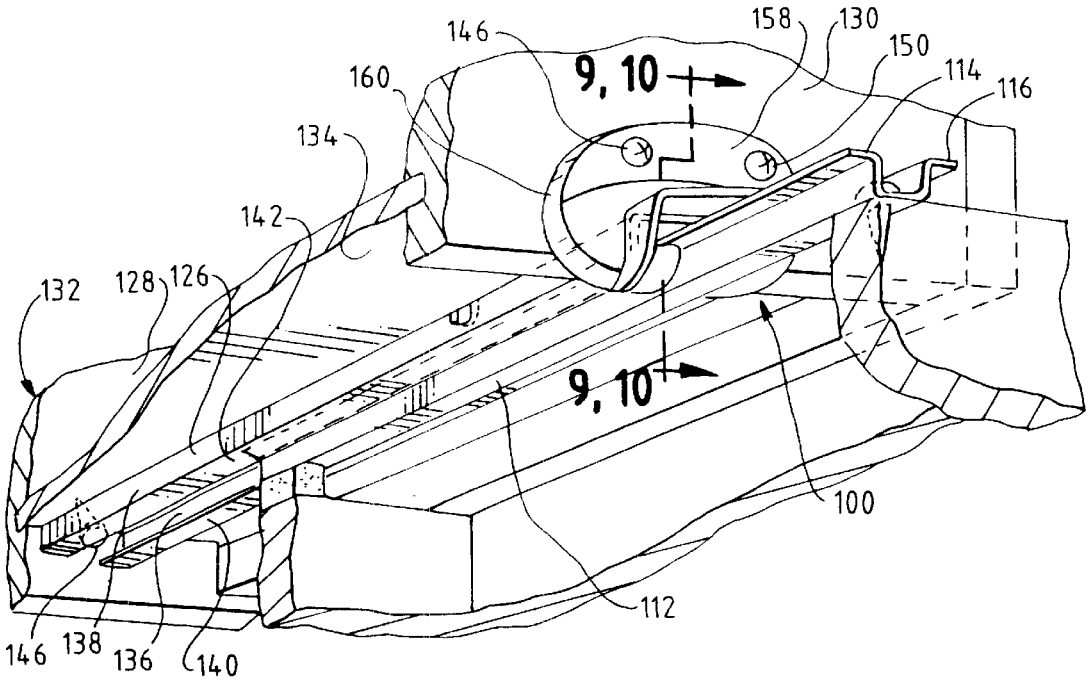
FIG. 4 is a rear perspective view, broken away, of a drawer slide assembly incorporating a first embodiment of a drawer glide having an imbedded reinforcement member therein.
Figure 5:
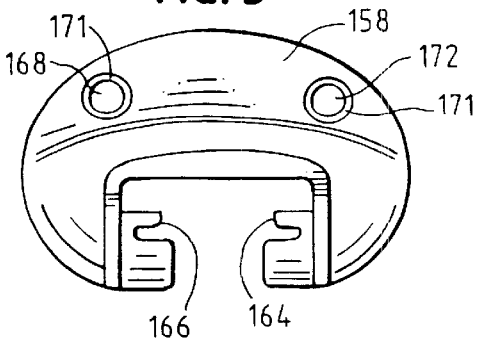
FIG. 5 is a rear plan view of the drawer glide shown in FIG. 4.
Figure 6:
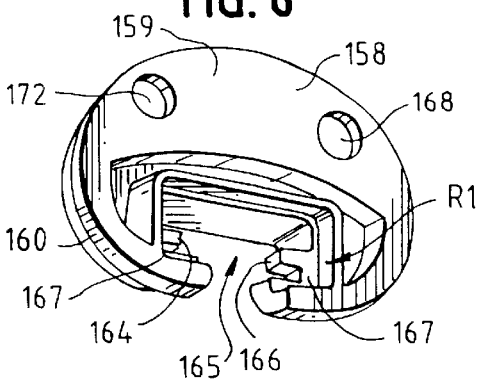
FIG. 6 is a front perspective view of the drawer glide shown in FIG. 4.
Figure 11:
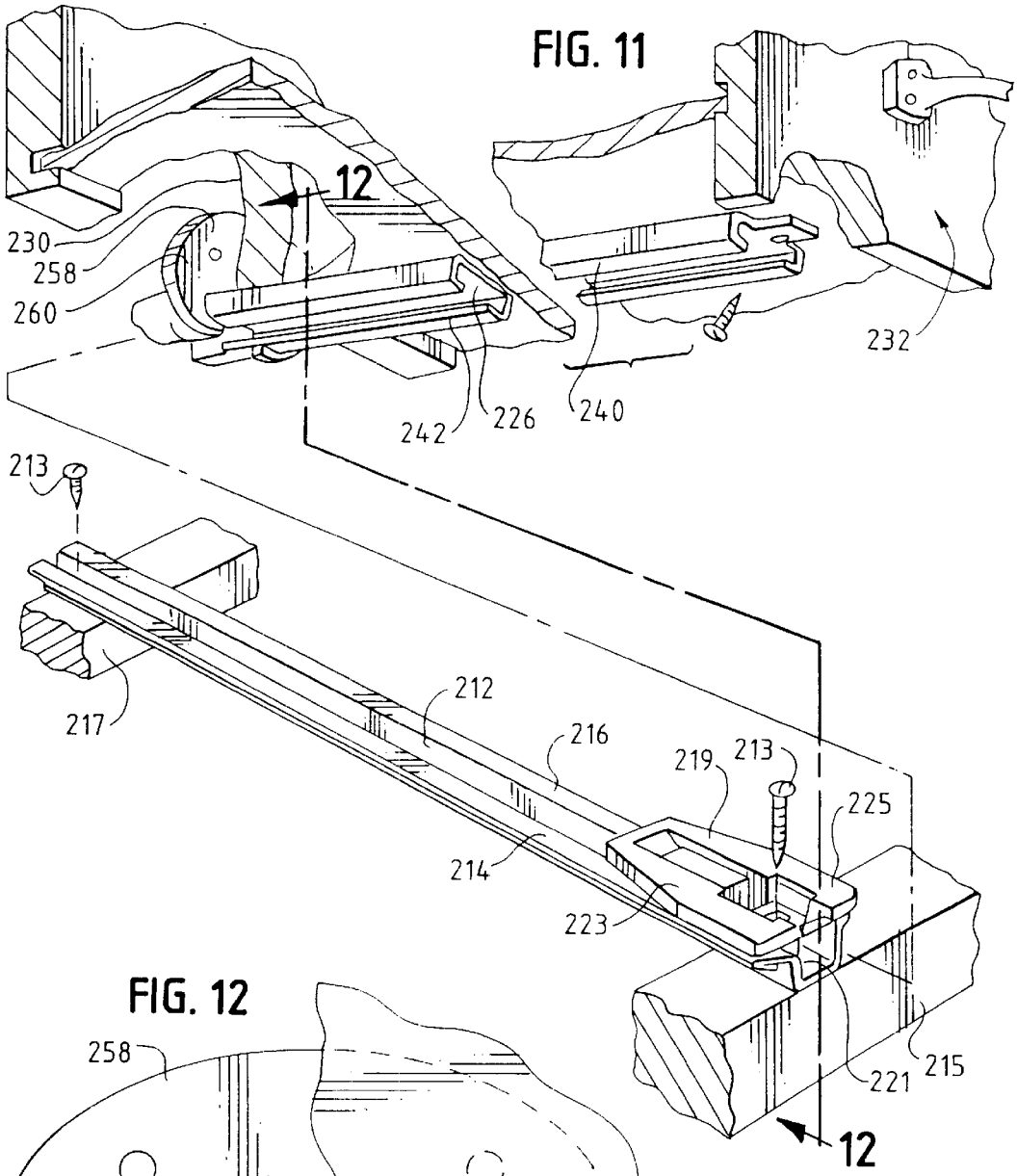
FIG. 11 is an exploded view of a drawer slide Assembly using a drawer glide of the present invention.
Figure 12:
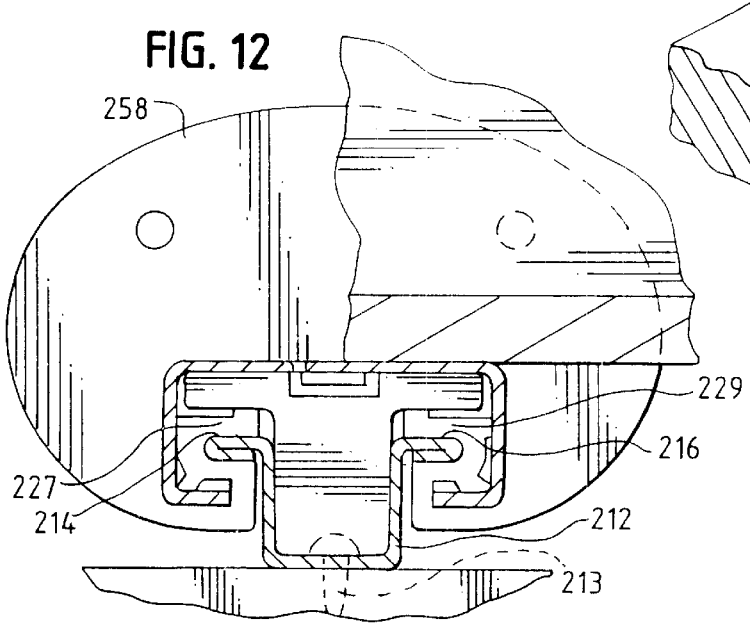
FIG. 12 is a front cross-sectional view, taken along line 12—12 of FIG. 11.
Figure 13:
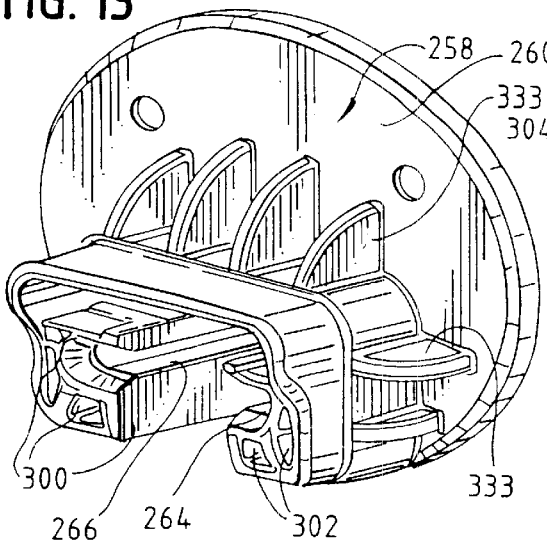
FIG. 13 is a rear perspective view of the drawer glide of the present invention.
Figure 14:
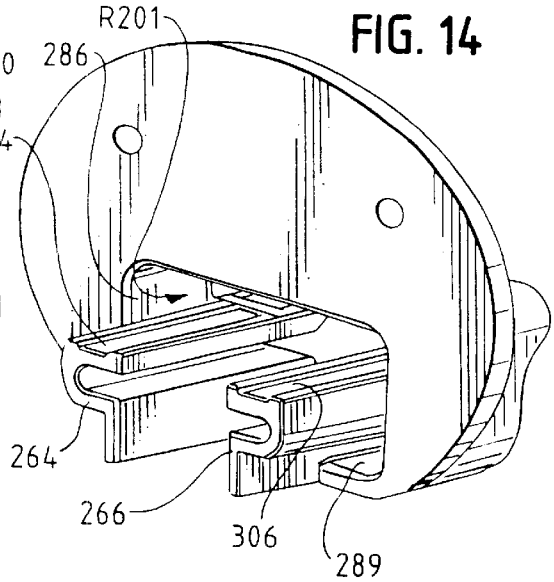
FIG. 14 is a front perspective view of the drawer glide shown in FIG. 13.
Figure 15:
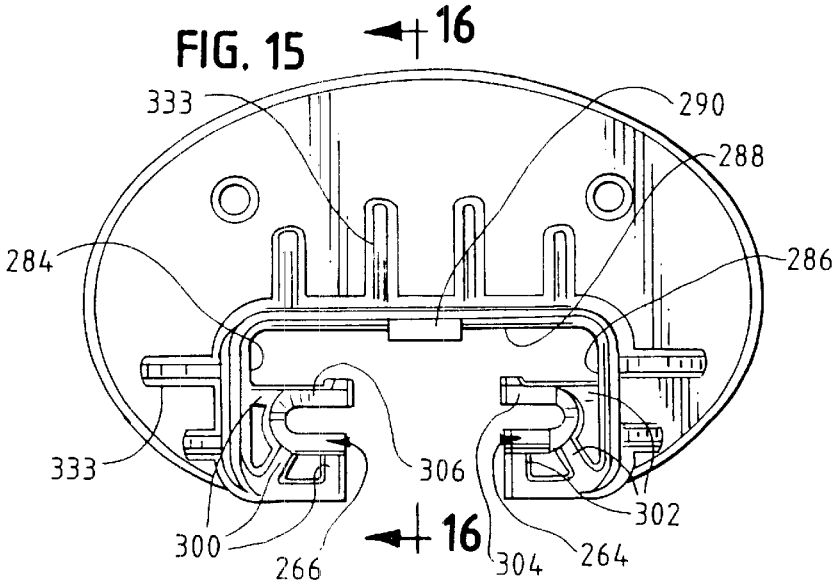
FIG. 15 is a rear plan view of the drawer glide shown in FIG. 13.

Referring first to FIGS. 1–3, a conventional drawer slide assembly 10 is shown to represent what exists in the prior art. The conventional drawer slide assembly 10 includes a stationary elongated lower metal drawer guide 12, also known as a case guide, or as a case runner, that is comprised of a rail having a substantially U-shaped cross-section, with horizontal, outwardly projecting flanges 14, 16. Although not shown in FIG. 1, the horizontal, outwardly-projecting flanges 14, 16 are preferably folded over along substantially their entire length, so that the flanges are essentially twice the thickness of the metal material used to form the metal drawer guide 12 (see, e.g., FIGS. 11 and 12). The drawer guide 12 is secured, for example by wood screws 18, 20, to the front drawer aperture cross support 22, and rear drawer aperture cross support 24, of a furniture unit. An elongated metal drawer slide 26 is secured to the front wall 28 and rear wall 30 of a drawer 32 along the bottom wall 34 of the drawer 32. The drawer slide 26 is C-shaped in cross-section, having vertical side walls 36, 38 and inwardly-directed horizontal flanges 40, 42.

The prior art drawer slide 26 is also equipped with an integral flange or tab 44 that extends vertically up the rear wall panel 30 of the drawer 32. A wood screw 46 or a similar fastening means is used to secure the drawer slide 26 to the front wall 28 of the drawer 32 at the corner of the front wall 28 and the bottom panel 34. The rear end of the prior art drawer slide 26 is secured to the rear wall panel 30 by wood screws 46, 48, 50 (or similar fastening means) that pass through screw-receiving apertures 52, 54, 56 in the integral tab 44.

In order to prevent direct, metal-to-metal contact of the drawer slide 26 along the drawer guide 12, a plastic drawer glide 58 is provided in the prior art drawer slide assembly 10 at the rear wall panel 30 of the drawer 32. The drawer glide 58 consists of a wall member 60, a rearward integral extension 62, and a pair of forwardly extending opposing ways 64, 66. The opposing ways 64, 66 are essentially question mark shaped in cross section. The drawer glide 58 is secured to the rear wall 30 by wood screws 46, 48, 50 (or by similar fastening means). The wood screws 46, 48, 50 pass through screw receiving apertures 68, 70, 72 in the wall member 60, with the screw receiving apertures 68, 70, 72 being axially aligned with the screw receiving apertures 52, 54, 56 in the integral tab 44 of the drawer slide 26.

The opposing ways 64, 66 of the drawer glide 58 receive the horizontal flanges 14, 16 of the drawer guide 12 and ride along the drawer guide 12. A gap or opening 74 in the drawer glide 58 located immediately above the opposing ways 64, 66 permits the drawer glide to pass over a plastic stop member (not shown), located near the front of the drawer guide 12. A pair of opposing, inwardly-directed stops 75 are provided on the vertical side walls 36, 38 of the drawer slide 26, which serve to temporarily stop the drawer glide 58, so the user has some warning or resistance before the drawer 32 is completely removed from the furniture unit, but removal of the drawer is still possible by applying sufficient pulling force to the drawer 32 so as to pull the stop member through the gap 74, and thus pull the drawer glide 58 and drawer slide 26 past the stop member. In other words, the stops 75 in the side walls 36, 38 the drawer slide 26 provide resistance to warn the user that the drawer 32 is approaching the front end of the drawer slide 26. In order to provide some strength to conventional the drawer glide 58, there are integral plastic rigidifying wall members, for example wall members 76, 78, on the exterior thereof.

Because the drawer slide 26 incorporates an integral tab 44 fastened to the rear wall panel 30 as the primary means of securing the drawer slide 26 to the drawer 32, conventional drawer slides have had to be drawer-length specific. Relatively high tolerances are required to ensure that the length of the drawer slide 26 corresponds to the length of the drawer 32 so that the tab 44 lies flush along the rear wall panel 30. Although the forwardly-extending opposing ways 64, 66 of the plastic drawer glide 58 extend into a rear end of the drawer slide 26, the opposing ways 64, 66 do not provide a substantial means of securing the rear end of the drawer slide 26 to the drawer 32. Instead, wood screws 46, 48, 50 must be used.

Reinforced Drawer Glides for Drawer Slide Assemblies

Turning now to FIGS. 4–10, the drawer slide assembly 100 originally disclosed in U.S. patent application Ser. No. 09/348,934 can accommodate a range of lengths of drawer slides for a given drawer length, resulting in a significant reduction in SKU's for suppliers of drawer slide assemblies, in as much as the present invention permits the use of a single drawer slide length to fit drawers in an array of specific given drawer lengths. The drawer slide assembly utilizes an improved drawer glide 158, and still utilizes an elongated U-shaped metal drawer guide 112 having horizontal outwardly-projecting flanges 114, 116. A drawer slide 126 is also provided.

Figure 9:
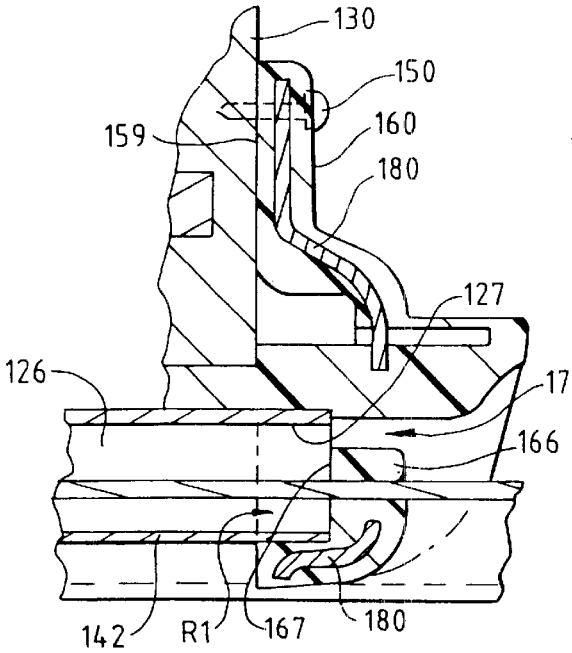
FIG. 9 is an enlarged cross-section taken along lines 9—9 of FIG. 4.
Figure 10:
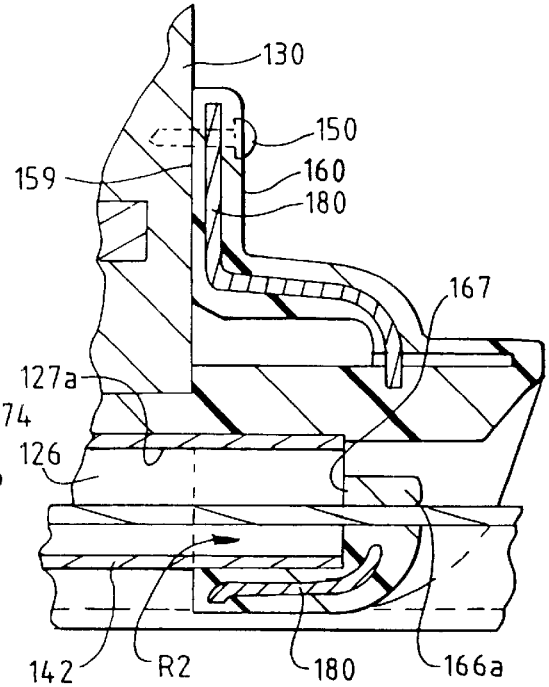
FIG. 10 is an enlarged cross-section, similar to the view shown in FIG. 9, but showing an alternate embodiment of the drawer glide shown in FIG. 5, taken along lines 10—10 of FIG. 4.

The drawer slide 126 is an elongated metal rail that is C-shaped in cross-section, having vertical side walls 136, 138 and inwardly projecting flanges 140, 142. Notably, the drawer slide 126 lacks an integral upwardly-extending tab at the rear end thereof. Instead, the drawer slide 126 has a rear-most portion 127 that extends rearwardly past the rear wall panel 130 of the drawer 132, as best shown in FIGS. 9 and 10. The drawer glide 158 has screw-receiving apertures 168, 172 in a wall member 160, through which wood screws 146, 150 (or similar fastening means) pass to secure the drawer glide 158 directly to the rear wall 130 of the drawer 132. Counter-sunk screw-head receiving circular bores 171 in a rear side of the drawer glide 158 are provided immediately about the screw-receiving apertures 168, 172 to provide a more flush exterior surface to the drawer glide 158 when the wood screws 146, 150 are in place. There is no integral tab at the rear end of the drawer slide 126, thus the front face 159 of the drawer glide 158 lies flush against the rear wall 130, without any intermediate metal tab portion.

The front end of the drawer slide 126 is secured in a conventional manner by a screw 146 or similar fastening means to the bottom wall 134 of the drawer 132, preferably at the corner of the bottom wall 134 and the front wall 128 of the drawer 132. The improved drawer guide 158 advantageously provides a means for securing the rear-most portion 127 of the drawer slide 126 to the drawer 132 without the need for an integral tab on the drawer slide 126. The securement means of the improved drawer glide 158 advantageously includes a C-shaped, downwardly-open aperture 165 that accommodates the rear-most portion 127 of the C-shaped drawer slide 126, which extends past the rear wall 130 of the drawer 132, thus solving the problem of the prior art wherein drawer slides had to be drawer-length specific. Most preferably, the entire cross-section of the drawer slide 126 extends past the rear wall 130 of the drawer 132.

A recess R1 (see FIG. 9) is provided within the drawer glide 158. The recess R1 extends rearwardly from the front face 159 and securely receives, preferably in a press fit, the portion 127 of the drawer slide 126 that extends rearwardly of the rear wall 130. Advantageously, the recess R1 is shaped to accommodate the rearmost portion 127 that is an extension of the entire cross-section of the drawer slide 126. By so accommodating the entire C-shaped cross-section of the drawer slide 126, the recess R1 allows for the drawer slide 126 to be manufactured without special additional cutting, rolling, or stamping operations to form any rearwardly extending adapter or tab portion at the rear end of the drawer slide 126.

The combination of the securement of this rear-most portion 127 of the drawer slide 126 in the recess R1, and the securement of the drawer glide 158 to the rear wall 130 via wood screws 146, 150 (or similar fastening means) effectively secures the rear of the drawer slide 126 to the bottom panel 134 of the drawer 132. As a result, a given drawer slide 126 can be used on a variety of lengths of drawers.

Production time in the shaping of drawer slides 126 is also advantageously reduced, because there is no need to form the integral tab members found in the drawer slide assemblies of the prior art. By way of example only, a suitable depth for the recess R1, i.e. the distance from the forward wall 167 of the opposing ways 164, 166 and a front face 159 of the drawer glide 158, is approximately ¼ inch. The maximum depth for the recess R1 is limited by the depth of the space behind the drawer 132 in the associated furniture unit when the drawer 132 is completely closed. Thus, the longest the recess R1 can suitably be in a particular drawer is a dimension such that the drawer glide 158 would not prevent complete closure of the drawer 132.

Figure 7:
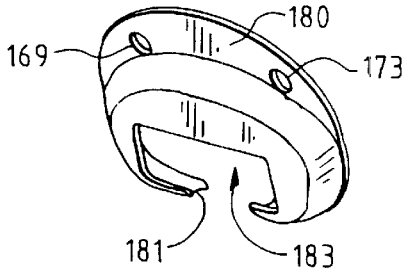
FIG. 7 is a rear perspective view of a metal insert plate used as the imbedded reinforcement member in the drawer glide shown in FIG. 5.
Figure 8:
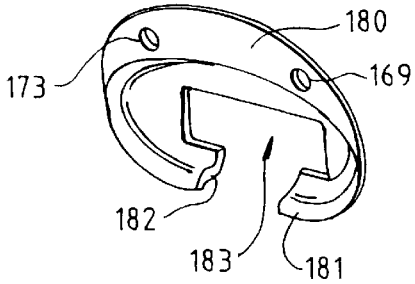
FIG. 8 is a front perspective view of the metal insert plate shown in FIG. 7.

The drawer glide 126 is also advantageously internally reinforced by a metal plate 180 imbedded within the drawer glide, shown in FIGS. 7 and 8. The drawer glide 126 is preferably manufactured by overmolding of the plastic exterior directly over the metal plate 180. The metal plate 180 is provided with apertures 169, 173 that align coaxially with screw-receiving apertures 168, 172, so the screws 146, 150 do not have to pierce through the metal plate 180 to secure the drawer glide 158 to the rear wall 130. The metal plate 180 is provided with a generally C-shaped, downwardly-open aperture 183 that serves to reinforce the generally C-shaped aperture 165 of the drawer glide 158. Advantageously, the metal plate 180 eliminates the need for rigidifying wall members on the exterior of the drawer glide 158.

The drawer glide 158 further includes opposing ways 164, 166 that are essentially question mark shaped in cross-section and extend inwardly from side walls of the C-shaped aperture 165. The forward-most, vertical end wall 167 of each of the opposing ways 164, 166 terminates rearwardly of the front face 159 of the drawer glide 158, and defines the rear end of the recess R1. Importantly, this means the rear-most portion 127 of the drawer slide 126 does not extend past the forward-most end wall 167 of the opposing ways 164, 166.

The opposing ways 164, 166 prevent direct metal-to-metal contact between the drawer slide 126 and the drawer guide 112. The opposing ways 164, 166 receive the horizontal, outwardly projecting flanges 114, 116 of the drawer guide 112, providing plastic-to-metal contact with the drawer guide 112, thereby facilitating movement of the drawer 132 along the drawer guide 112. The metal plate 180 has lower portions 181, 182 that are S-shaped in cross-section, which provide internal reinforcement to the opposing ways 164, 166. Advantageously, the lower portions 181, 182 also provide enhanced support to the drawer slide 126, which is important to accommodate the weight of the contents of the drawer 132.

A gap 174 in the drawer glide 158 immediately above the top surface of the opposing ways 164, 166 allows the drawer glide 158 to pass over a preferably plastic stop member (see FIG. 11) located near the front end of the drawer guide 112 without resistance.

In another embodiment, shown in FIG. 10, the recess R2 is an elongated recess, to accept a greater variety of lengths of drawer slides. In this embodiment, the opposing ways 166*a* have a forward wall 167*a* that is more remote in a rearward direction from the rear wall panel 130 of the drawer 132 than in the previous embodiment. As a result, the drawer slide 126 can have a rear-most portion 127*a* that extends farther past the rear wall panel 130 than the previous embodiment.

Preferably, the depth of this elongated or deeper recess is at least ½ inch, which allows for use of ¼" increments in the sizing of drawer slides. Again, the maximum suitable depth for the recess R2 would be a depth such that the drawer glide 158 does not prevent complete closure of the drawer 132 in its associated furniture Unit. This embodiment results a significant reduction in the amount of SKU's, because the recess R2 makes it unnecessary for the drawer slide to be drawer-length specific.

Externally Reinforced and Interlocking Drawer Glides

The embodiments of the drawer glide just described included internal reinforcement in the form of an imbedded metal plate 180. While such a drawer glide has many advantages over drawer slide assemblies found in the prior art, there are still several disadvantages. There is additional cost and increased complexity involved in manufacturing a plastic drawer glide that is overmolded on the metal plate 180. Also, while the recesses R1 and R2 in the drawer glides described above do provide a high level of securement of the drawer slide 126, the drawer glide can still be fairly easily pulled off the end of the drawer slide 126 during assembly. As a result, those persons assembling a furniture article are not assured that the drawer slide 126 and drawer glide will remain together as a unit until the securement screws 150 are used to secure the drawer glide to the rear wall 130 of the drawer.

Thus, the latest embodiments of the present invention, as shown in FIGS. 11–23, include locking means, discussed in greater detail below, for reliably securing the drawer slide 226 within the drawer glide 258. Where possible, reference numbers in FIGS. 11–23 correspond to similar elements in the drawer slide assembly of FIGS. 4–10, with the reference numbers increased by a factor of 100. For example, there is a drawer slide 126 in the drawer slide assembly of FIG. 4, and there is a drawer slide 226 in the drawer slide assembly of FIG. 11.

The drawer glide 258 of the present invention has a main wall member 260 with a front face that abuts the rear wall 230 of the drawer 232. A case runner, also called a drawer guide 212, is secured by wood screws 213 to a front cross rail 215 and a rear cross rail 217 of the furniture article, preferably in such a manner that the drawer guide 212 is centrally disposed in the bottom of a drawer-receiving cavity within the furniture article. The drawer guide 212 is generally U-shaped in cross-section, with outwardly-projecting horizontal flanges 214, 216, which are preferably folded over along substantially their entire length, so that the effective thickness of the flanges 214, 216 is twice the thickness of the material used to form the drawer guide 212.

A plastic case glide or stop member 219, having a generally rectangular integral base portion 221, is securably seated between the sidewalls of the U-shaped drawer guide 212, and has a pair of tapering horizontal flanges 223, 225 at the top thereof. The tapering horizontal flanges 223, 225 are spaced a short distance, preferably approximately 0.403 inch, from the tops of the outwardly-projecting horizontal flanges 214, 216 of the drawer guide 212. Advantageously, this leaves gaps 227, 229 on either side of the rectangular integral base portion 221 between the two pairs of flanges.

Turning to FIGS. 13–16 and 22–23, the drawer glide 258 includes a recess R201 that accommodates a rear-most portion of the drawer guide 226 extending past the rear wall 230 of a drawer. The recess R201 is delimited by a pair of sidewalls 284, 286 and a top wall 288. There are also horizontal inwardly-projecting floors 287, 289 at the bottom of the recess R201.

The drawer glide 258 has opposing ways 264, 266 that are essentially question mark shaped in cross-section and extend inwardly from side walls 284, 286 of the recess R201. Supporting struts 300, 302 may be provided instead of having solid material between the opposing ways 264, 266 and the respective side walls 284, 286, in-order to save material, without significantly detracting from the strength of the opposing ways 264, 266.

Figure 16:
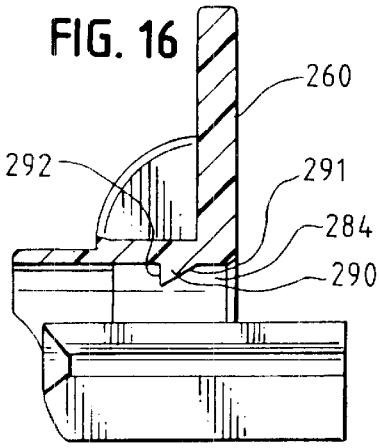
FIG. 16 is a cross-sectional view, taken along lines 16—16 of FIG. 15.
Figure 17:
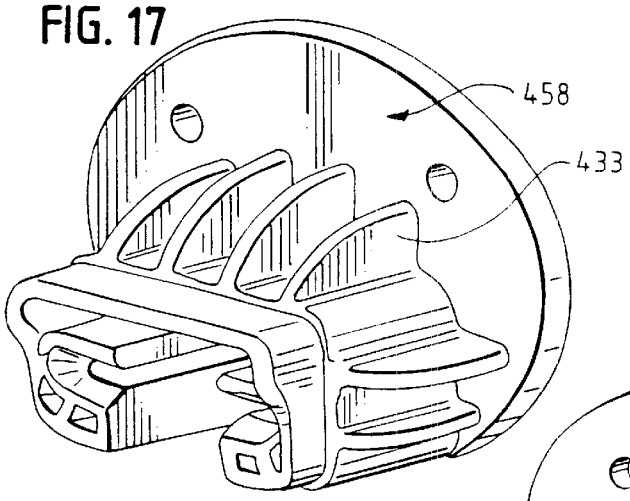
FIG. 17 is a rear perspective view of an alternate embodiment of the drawer glide shown in FIGS. 13–16, wherein the female recess is deeper to accommodate a longer rear-most portion of the drawer slide.
Figure 18:
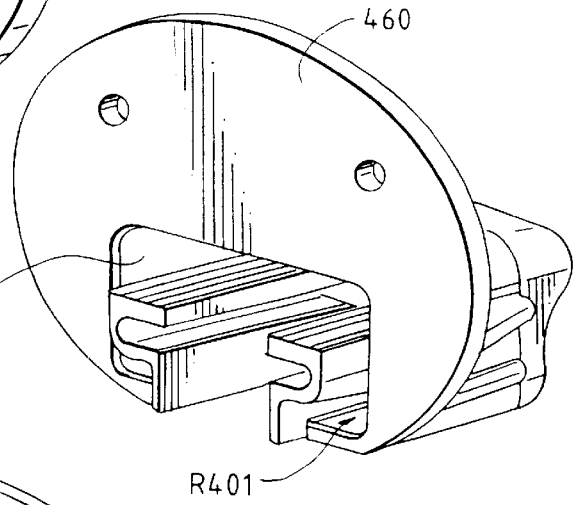
FIG. 18 is a front perspective-view of the drawer glide shown in FIG. 17.
Figure 19:
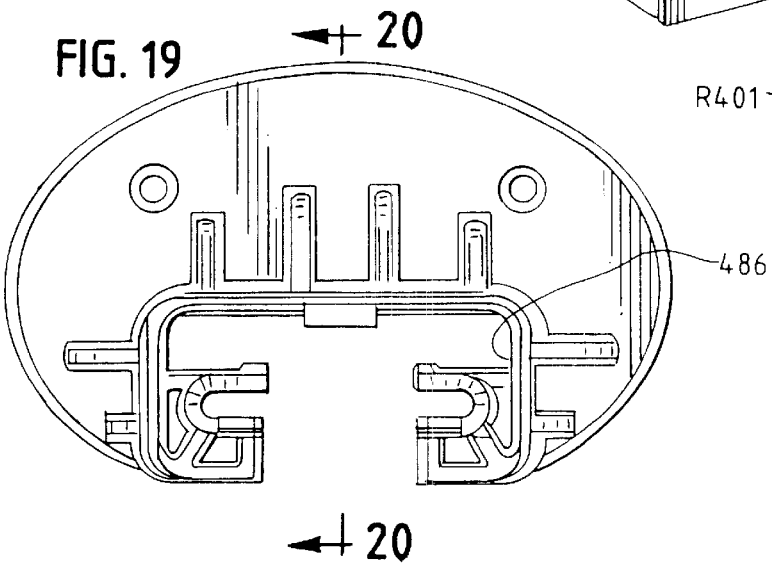
FIG. 19 is a rear plan view of the drawer glide shown in FIG. 17.
Figure 20:
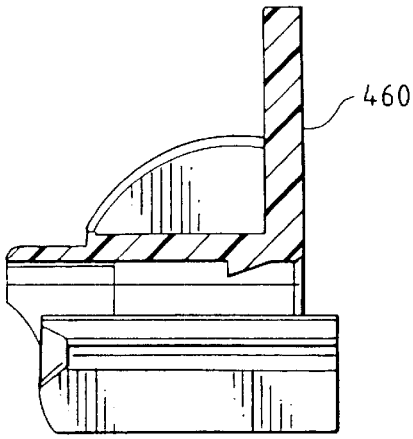
FIG. 20 is a cross-sectional view, taken along lines 20—20 of FIG. 19.
Figure 21:
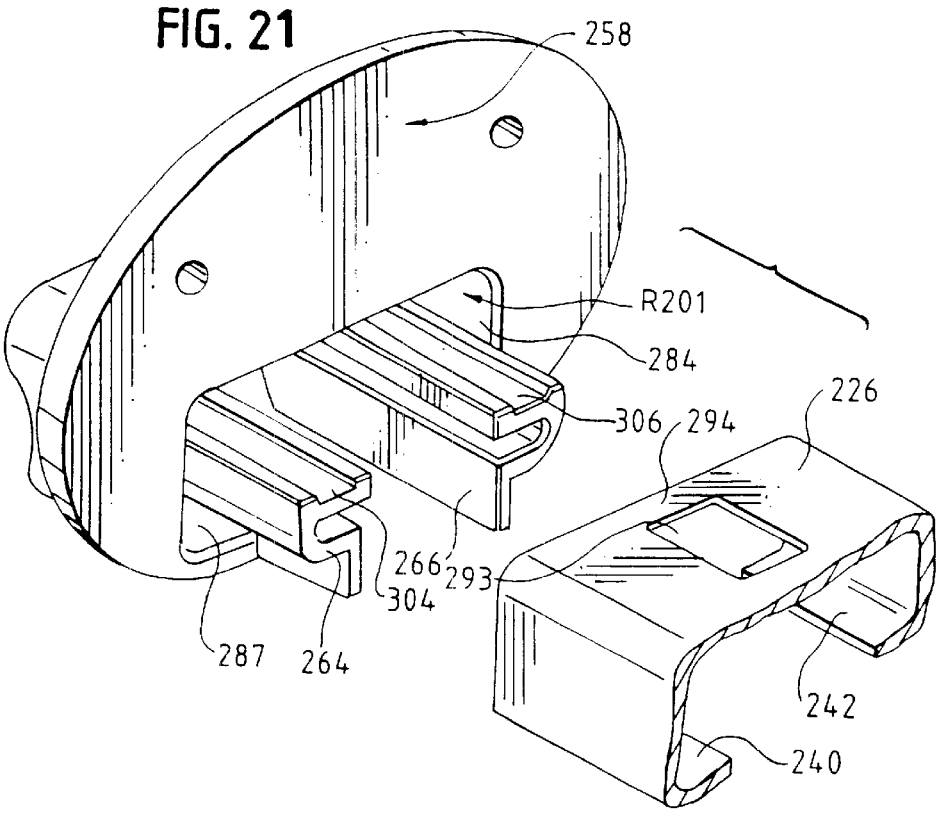
FIG. 21 is an exploded view, with most of the drawer slide cut away, showing the drawer slide just before it is received within the drawer glide.
Figure 22:
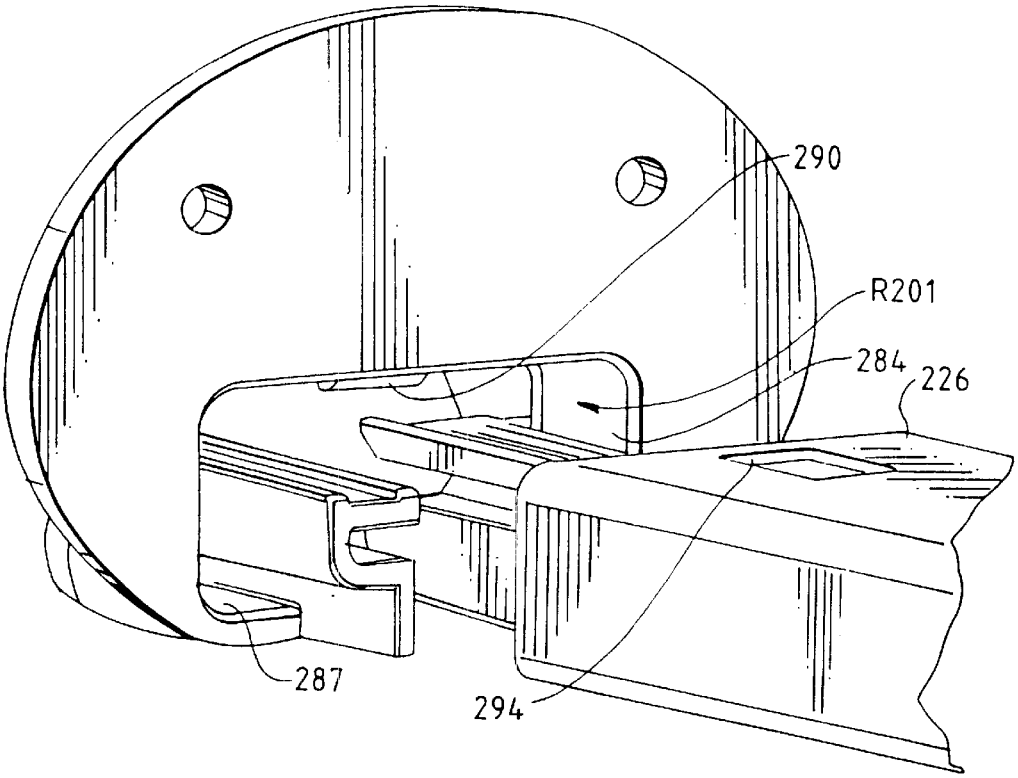
FIG. 22 is an enlarged view, similar to FIG. 21, and showing the locking tab within the drawer glide.

As best shown in FIGS. 16 and 22, the drawer glide 258 advantageously is equipped with a securing mechanism in the form of a ramped tab member 290, which is preferably centrally located on an underside of the top wall 288 of the recess R201. The ramped tab member 290 has an inclined or sloped portion 291, and a generally vertical locking wall surface 292. The rear most portion of the drawer slide 226 is provided with a corresponding aperture 293, sized to accommodate the ramped tab member 290. The dimensions of the C-shaped drawer slide 226 and the recess R201 are such that the drawer slide 226 fits tightly within the recess R201, with the horizontal flanges 240, 242 of the drawer slide 226 seated on the floors 287, 289 of the drawer glide 258. Thus, as the drawer slide 226 is inserted into the glide 258, a portion 294 at a rear end of the aperture 293 is pressed downwardly as the portion 294 rides along the included portion of the ramped tab member 290 until the portion 294 clears the ramped tab member 290, at which time an audible "snap" sound is detected as the portion 294 snaps into locking engagement behind the locking wall surface 292. This beneficially achieves a secure engagement of the drawer slide 226 and drawer glide 258, and ensures perpendicularity between the main wall member 260 of the drawer glide 258, and the drawer slide 226.

The snap locking mechanism also facilitates pre-assembly of the drawer slide 226 and drawer glide 258, which can speed up the furniture assembly process. The ramped tab member 290 is spaced rearwardly of the main wall member 260 for greater securement of the drawer slide 226.

Another advantage of the present invention is the extension of the opposing ways 264, 266 forwardly of the main wall member 260. By extending the opposing ways 264, 266, there is a greater gliding surface achieved between the drawer glide 258 and the horizontal flanges 214, 216 of the U-shaped drawer guide 212. This results in added stability when sliding the drawer 232 along the drawer guide 212, which reduces undesirable side-to-side play or movement of the drawer 232.

When inserting the drawer 232 into a drawer-receiving cavity (not shown) of a furniture article, such that the drawer glide 258 will be in sliding engagement with the case runner 212, the upper portion 304 of the opposing way 266 passes between the horizontal flange 216 of the case runner 212 and the tapering flange 225 of the stop member 219, while the upper portion 306 of opposing way 264 passes between the horizontal flange 214 and the tapering flange 223.

Because the C-shaped drawer slide 226 essentially surrounds the outer sides of the forwardly-projecting portions of the opposing ways 264, 266, the drawer slide 226 provides additional reinforcement to the opposing ways 264, 266.

Another feature of the drawer glide 258 is the use of gussets 333 that are generally pie-shaped, or web-shaped, between the top 288 and side walls 284, 286 of the recess R201, and the rear of the main wall member 260. These integral gussets 333 avoid the need for internal, imbedded reinforcement, but still provide added strength and stability to the drawer glide 258.

FIGS. 17–20 demonstrate an alternate embodiment of the drawer glide 458. The drawer glide 458 is essentially the same as the drawer glide 258 of the previous embodiment, but with an elongated recess R401. This arrangement allows for a greater range of lengths of drawer slides that can be accommodated by the drawer glide, because the main wall member 460 can still lie flush against a rear wall 230 of a drawer 232 with a greater length of the drawer slide extending rearwardly of the rear wall 230. As a result, the drawer manufacturer can produce fewer varieties of lengths of drawer slides, while still achieving the other benefits of the present invention.

While the present invention has been described with respect to various embodiments thereof, it will be appreciated by those of ordinary skill in the art that modifications may be made thereto that are still within the scope of the appended claims.

We claim:

1. An improved drawer glide comprising:

a wall member;

a pair of opposing ways for receiving a pair of horizontal flanges of an elongated drawer guide;

a recess for receiving a rear most end of a drawer slide; and a ramped locking tab provided on a top wall of said recess for locking a drawer slide within said recess.

2. The drawer glide of claim 1, wherein said ramped locking tab includes an inclined surface spaced inwardly of the wall member.

3. The drawer glide of claim 1, wherein the ramped locking tab slopes rearwardly, from a first height flush with said upper wall of the recess to a second height lower than said top wall of the recess.

4. The drawer glide of claim 3, wherein said ramped locking tab terminates at a generally vertical locking end wall surface.

5. The drawer glide of claim 1, in combination with a drawer slide received in said recess, said drawer slide being generally C-shaped in cross-section and including an aperture in an upper wall thereof that is lockingly engaged by said ramped locking tab, a pair of sidewalls extending downwardly from the upper wall, and an inwardly directed flange at a bottom of each of the sidewalls, said inwardly directed flanges disposed between a bottom wall of the recess of the drawer glide and the opposing ways of the drawer glide.

6. An improved drawer glide comprising:

a wall member;

a pair of opposing ways for receiving a pair of horizontal flanges of an elongated drawer guide, each of said opposing ways extending forwardly and rearwardly of said wall member;

drawer slide receiving means comprising a recess in said wall member, said recess extending rearwardly from a front face of said drawer glide, and said recess including a top wall with a ramped locking tab for lockingly engaging a portion of a drawer slide extending rearwardly of said wall member.

7. The drawer glide of claim 6, wherein each of said opposing ways is connected to at least one wall of said recess by one or more elongated struts, whereby said opposing ways are reinforced against bending outwardly due to forces exerted by horizontal flanges of a drawer slide slidingly engaged by the opposing ways.

8. The drawer glide of claim 6, wherein said recess is further defined by at least a pair of sidewalls extending rearwardly of said wall member and extending downwardly of said top wall.

9. The drawer glide of claim 8, wherein a central axis of said ramped locking tab is located at a position on said top wall that is halfway between said sidewalls.

10. The drawer glide of claim 8, further including one or more external reinforcement gussets connecting said sidewalls to a rear face of said wall member.

11. The drawer glide of claim 8, further including one or more external reinforcement gussets connecting said top wall to a rear face of said wall member.

12. The drawer glide of claim 8, wherein said wall member is further provided with a plurality of apertures therein to receive mounting screws.

13. An improved drawer slide assembly having an elongated metal drawer guide secured to a furniture unit, said elongated drawer guide being generally U-shaped in cross-section and having a pair of outwardly-directed horizontal flanges at an upper end thereof, an elongated metal drawer slide secured to a bottom panel of a drawer, and a plastic drawer glide secured to a rear panel of the drawer, the drawer glide having a main wall member oriented parallel to and flush against said rear panel of the drawer, and a pair of inwardly-directed opposing ways to receive said outwardly-directed horizontal flanges of the elongated metal drawer guide, the improvement comprising:

said opposing ways extending forwardly and rearwardly of said main wall member;

said drawer glide having a recess therein defined by a top wall and a pair of sidewalls, said top wall and said sidewalls extending rearwardly of said main wall member and including a plurality of reinforcement gussets connecting the top wall and the sidewalls to a rear face of the main wall member; and a locking ramped tab provided on said top wall of the recess for lockingly engaging said drawer slide, the drawer slide including an aperture for receiving said ramped locking tab.

14. The drawer slide assembly of claim 13, wherein in said drawer guide, said ramped locking tab is spaced rearwardly of said main wall member.

15. The drawer slide assembly of claim 13, wherein in said drawer guide, said ramped locking tab slopes rearwardly, from a first height flush with said top wall of the recess to a second height lower than said top wall of the recess.

16. The drawer glide of claim 15, wherein said ramped locking tab terminates at a generally vertical locking end wall surface.

17. The drawer glide of claim 16, wherein a central axis of said ramped locking tab is located at a position on said top wall that is halfway between said sidewalls.

18. The drawer glide of claim 13, wherein said drawer slide is substantially C-shaped in cross-section and includes an upper wall, a pair of sidewalls extending downwardly from the upper wall, and an inwardly directed flange at a bottom of each of the sidewalls, said inwardly directed flanges disposed between a bottom wall of the recess of the drawer glide and the opposing ways of the drawer glide, and wherein a portion of said drawer slide lockingly received in said drawer guide surrounds said opposing ways, whereby said opposing ways are reinforced against outward forces exerted by said outwardly-directed horizontal flanges of the drawer guide.

* * * * *